United States Patent [19]

Sato

[11] Patent Number: 4,921,443

[45] Date of Patent: May 1, 1990

[54] WATERPROOFING ASSEMBLY FOR TERMINAL AREA OF ELECTRIC WIRE

[75] Inventor: Kenichi Sato, Shimada, Japan

[73] Assignee: Yazaki Corporation, Tokyo, Japan

[21] Appl. No.: 362,515

[22] Filed: Jun. 7, 1989

[30] Foreign Application Priority Data

Jun. 9, 1988 [JP] Japan ..... 63-75791[U]

[51] Int. Cl.[5] ..... H01R 13/52

[52] U.S. Cl. ..... 439/521; 174/138 F; 439/447; 439/892

[58] Field of Search ..... 174/77 S, 138 F; 429/65; 439/125, 127, 128, 278, 279, 445, 447, 519, 521, 522, 523, 750, 892

[56] References Cited

U.S. PATENT DOCUMENTS 1,803,908 5/1931 Lansing ..... 174/138 F X
2,468,225 4/1949 Murphy ..... 174/138 F X
2,814,667 11/1957 Hollins ..... 174/138 F
3,528,051 9/1970 Toedtman et al. ..... 174/138 F X

*Primary Examiner*—Laramie E. Askin
*Attorney, Agent, or Firm*—Venable, Baetjer and Howard

[57] ABSTRACT

A waterproofing assembly for use in a terminal area of an electric wire comprises a terminal fixedly secured to an apparatus body, and a cap made of a flexible elastic material for covering the terminal and a part of the electric wire connected therewith. The above-mentioned terminal is formed in the shape of a dish whose outer peripheral portion is inclined. The cap has an opening formed therein whose edge is formed in the shape of an "O" ring, and a bellows-shaped portion formed in the vicinity of the electric wire covering portion thereof. The edge of the opening of the above-mentioned cap is adapted to be fitted resiliently into a wedge-shaped space formed between the inclined portion of the terminal and the apparatus body.

1 Claim, 2 Drawing Sheets

WATERPROOFING ASSEMBLY FOR TERMINAL AREA OF ELECTRIC WIRE

BACKGROUND OF THE INVENTION 1. Field of the Invention

This invention relates to a waterproofing assembly for a terminal area of electric wires. 2. Description of the Prior Art According to a prior art waterproofing assembly for a terminal area of electric wires, a terminal made of an electrically conductive metal, which is connected with the leading end of an electric wire, is fixedly secured to a terminal of an apparatus body by means of a nut. A cap for covering this terminal area is comprised of a middle portion adapted to cover the central portion of the terminal, an opening whose edge is adapted to be fitted tightly onto the upper surface of the apparatus body, and an extension which extends from the middle portion so as to cover a part of the electric wire. The above-mentioned component parts of the cap are molded integrally out of a flexible elastic material such as, for example, a synthetic rubber. Waterproofing of the terminal area is made by depressing the above-mentioned cap until the above-mentioned nut fits in it thereby allowing the edge of the opening to be fitted tightly by the resiliency thereof onto the upper surface of the apparatus body.

The above-mentioned waterproofing assembly cannot be recognized satisfactory in terms of waterproofness. If the electric wire is pulled upwardly by an external force applied thereto, the opening of the cap is lifted appreciably from the upper surface of the apparatus body so that there is a risk of water or moisture making ingress through a crevice formed therebetween, thereby impairing the waterproof performance thereof markedly.

Accordingly, the present invention has been made in view of the above-mentioned circumstances in the prior art, and has for its object or subject to provide a waterproofing assembly for a terminal area of an electric wire, which is capable of affording always satisfactory waterproof performance regardless whether or not the electric wire is subjected to external forces.

SUMMARY OF THE INVENTION

The waterproofing assembly for a terminal area of an electric wire devised by the present invention to solve the above-mentioned problem comprises a terminal fixedly secured to an apparatus body, and a cap made of a flexible elastic material for covering the terminal and a part of the electric wire cord connected therewith, and is characterized in that said terminal is formed in the shape of a dish whose peripheral portion is inclined; said cap has an opening formed therein whose edge is formed in the shape of an "O" ring, and a bellows-shaped portion formed in the vicinity of the electric wire covering portion thereof, the arrangement being made such that the edge of the opening of the cap is fitted resiliently into a wedge-shaped space formed between the inclined portion of the terminal and the apparatus body.

In the above-mentioned assembly, the edge of the opening of the cap is held tightly between the apparatus body and the terminal area so that the "O"-ring-shaped edge of the opening can be caught securely in the wedge-shaped space. Further, even if the electric wire is bent by an external force applied thereto, the bellows-shaped portion will absorb the force so that the external force is not transmitted to the opening, thereby avoiding deformation thereof.

DESCRIPTION OF THE PREFERRED EMBODIMENTS

Figure 3:
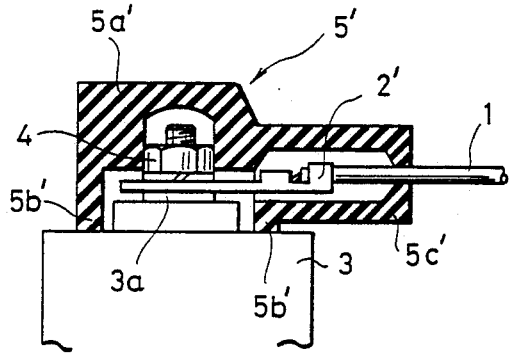
FIG.3 PRIOR ART
FIG. 3 is a sectional view showing a prior art waterproofing assembly for a terminal area of an electric wire.
Figure 4:
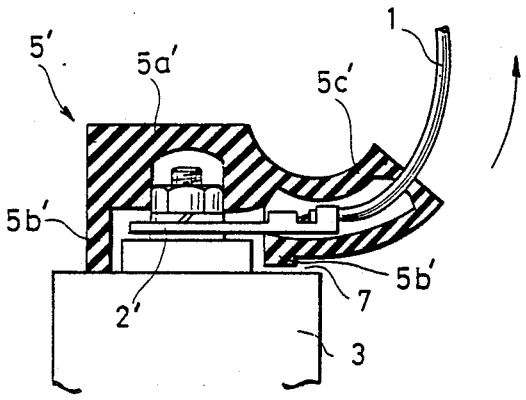
FIG.4 PRIOR ART
FIG. 4 is a sectional view for explaining the function of the prior art waterproofing assembly shown in FIG. 3.

FIGS. 3 and 4 show a conventional waterproofing assembly for a terminal area of an electric wire. A terminal 2' made of an electrically-conductive metal, which is connected to the leading end of an electric wire 1, is fixedly secured to a terminal 3*a* of an apparatus body 3 by means of a nut 4. A cap 5' for covering this terminal area, is comprised of a middle portion 5*a'* adapted to cover the central part of the terminal 2', an opening whose edge 5*b'* is adapted to be fitted tightly onto the upper surface cf the apparatus body 3, and an extension 5*c'* which extends from the middle portion 5*a'* so as to cover a part of the electric wire 1. Waterproofing of the terminal area is made by depressing the cap 5' until the nut 4 fits in it thereby allowing the edge 5*b'* of the opening to be fitted tightly by the resiliency thereof onto the upper surface of the apparatus body 3.

In the above-mentioned waterproofing assembly, since the periphery of the terminal area is sealed only by the resilient force of the cap 5', not only sufficient waterproofness of the terminal area cannot be obtained, but also when the electric cable 1 is pulled upwardly by an external force applied thereto as shown in FIG. 4, the edge 5*b'* of the cap 5' is lifted appreciably from the upper surface of the apparatus body 3 so that there is a risk of water or moisture making ingress through a crevice 7 formed therebetween.

Figure 1:
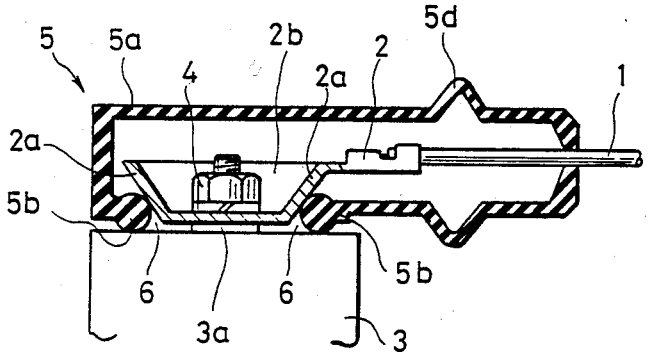
FIG. 1 is a sectional view of one embodiment of the waterproofing assembly for a terminal area of an electric wire according to the present invention in ordinary condition of use.
Figure 2:
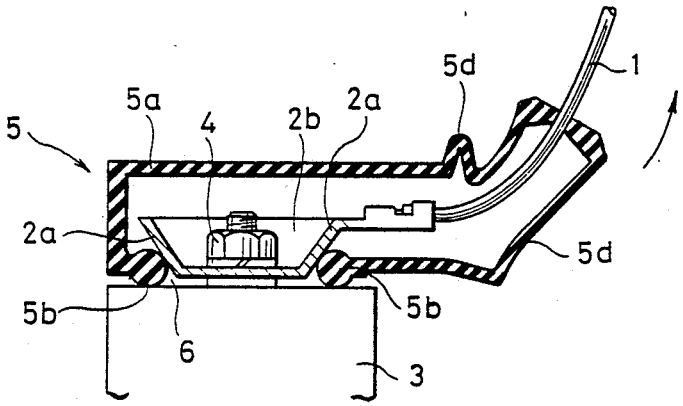
FIG. 2 is a sectional view of the embodiment shown in FIG. 1 when an external force is applied to the electric wire.

FIGS. 1 and 2 are sectional views illustrating one embodiment of the waterproofing assembly for a terminal area of an electric wire according to the present invention. FIG. 1 shows the waterproofing assembly in the normal condition of use, whilst FIG. 2 shows the same when the electric wire is subjected to an external force. In these figures, the fixing of the terminal 2 to the electric wire 1 and the fixing of the terminal 2 to the apparatus body 3 are identical to those of the prior art assembly described above, and therefore the description thereof is omitted herein.

As can be seen from the sectional views, the peripheral portion of the terminal 2 is of an upwardly divergent dish shape. Stating in brief, the terminal 2 has an upwardly and outwardly extending inclined portion 2*a* forming a space 2*b* therein, in which the terminal 3*a* of the apparatus body 3 and the nut 4 etc. are located.

A cap 5 adapted for use in this embodiment has an opening whose edge 5*b* is formed in the shape of an "O" ring having a somewhat larger thickness, and an extension 5*c* covering the connection of the electric wire 1 and the terminal 2 and having a bellows-shaped portion 5*d* formed in a part thereof. And, the "O"-ring-shaped edge 5*b* of the opening is fitted in the wedge-shaped space 6 formed between the inclined portion 2*a* of the above-mentioned terminal board 2 and the apparatus body 3 so that the edge 5*b* of the opening can always be forced into the wedge-shaped space 6 by the resiliency thereof, thereby blocking the clearance between the terminal 2 and the apparatus body 3.

In the above-mentioned construction, since the diameter of the opening of the cap 5 is somewhat smaller than that of the wedge-shaped space 6, the water-tightness of the terminal area can be maintained without impairing the ease of mounting of the edge 5*b* of the opening. Furthermore, since the "0"-ring-shaped edge 5*b* of the opening is always subjected to a force towards the wedge-shaped space 6, and hence, an elastic deformation, even if it is subjected to a tensile force to some degree, there is no fear of it losing the tight-fitness thereof.

Further, even when the electric wire 1 is pulled upwardly by an external force applied thereto as shown in FIG. 2, the above-mentioned bellows-shaped portion 5*d* formed in the cap 5 is deformed (the inside portion of the bend is contracted and the outside portion thereof is elongated as shown) so as to absorb the tensile force so that the tensile force is not transmitted to the edge 5*b* of the opening. Thus, the cooperation of the opening itself with the bellows-shaped portion 5*d* ensures satisfactory water-tightness of the terminal area.

Furthermore, the configurations of the inclined portion 2*a* of the terminal 2, the "O"-ring-shaped edge 5*b* of the opening, the bellows-shaped portion 5*d*, and the wedge-shaped space 6, etc. according to the present invention are not to be limited to those shown in the drawings, but can be varied within the scope and spirit of the present invention.

As mentioned hereinabove, according to the present invention, since the terminal area of an electric wire is sealed by fitting the "O"-ring-shaped edge of the opening into the wedge-shaped space, and possible deformation of the opening of the cap due to external forces applied thereto is prevented by the action of the bellows-shaped portion formed in the cap, not only in ordinary condition of use, but also even when the electric wire is subjected to external forces, the waterproofness of the terminal area thereof can always be maintained.

It is to be understood that the foregoing description is merely illustrative of a preferred embodiment of the present invention, and that the scope of the invention is not to be limited thereto, but is to be determined by the scope of the appended claim.

What is claimed is:

1. A waterproofing assembly for a terminal area of an electric wire comprising: a terminal fixedly secured to an apparatus body, and a cap made of a flexible elastic material for covering the terminal and a part of the electric wire cord connected therewith, wherein said terminal is formed in the shape of a dish whose outer peripheral portion is inclined; said cap has an opening formed therein whose edge is formed in the shape of an "O" ring, and a bellows-shaped portion formed in the vicinity of the electric wire covering portion thereof, the arrangement being made such that the edge of the opening of said cap is fitted resiliently into a wedge-shaped space formed between the inclined portion of said terminal and the apparatus body.

* * * * *